US010391516B2

(12) United States Patent
Sumiyoshi

(10) Patent No.: US 10,391,516 B2
(45) Date of Patent: Aug. 27, 2019

(54) APPLICATOR WITH ROTARY CAM PISTON MECHANISM

(71) Applicant: MITSUBISHI PENCIL COMPANY, LIMITED, Tokyo (JP)

(72) Inventor: Satoru Sumiyoshi, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 237 days.

(21) Appl. No.: 15/479,518

(22) Filed: Apr. 5, 2017

(65) Prior Publication Data

US 2017/0297050 A1 Oct. 19, 2017

(30) Foreign Application Priority Data

Apr. 14, 2016 (JP) ..... 2016-080909

(51) Int. Cl.
*A45D 34/04* (2006.01)
*B05C 17/005* (2006.01)
(Continued)

(52) U.S. Cl.
CPC ..... *B05C 17/00576* (2013.01); *A45D 34/04* (2013.01); *A46B 11/002* (2013.01);
(Continued)

(58) Field of Classification Search
CPC ..... A45D 34/04; A45D 2200/054; A45D 2200/055; A45D 2200/056; A46B 11/0055; A46B 11/002; B43K 5/06; B43K 5/08; B43K 5/189; B43K 5/1827; B43K 5/1818; B43K 5/1863; B43K 5/1836; B05C 17/00576; B05C 17/0116; B05C 17/0146; B05B 11/0035; B05B 11/0064;
(Continued)

(56) References Cited

U.S. PATENT DOCUMENTS 2,091,649 A * 8/1937 Olson ..... B43K 5/06 401/145
6,200,055 B1 * 3/2001 Fusaro, Jr. ..... A45D 34/042 401/151
(Continued)

FOREIGN PATENT DOCUMENTS

EP 0 357 455 A2 3/1990
EP 2 859 958 A1 4/2015
(Continued)

OTHER PUBLICATIONS

Extended Search Report dated Sep. 15, 2017, issued in counterpart European Application No. 17164963.5 (10 pages).

*Primary Examiner* — Patrick M. Buechner
(74) *Attorney, Agent, or Firm* — Westerman, Hattori, Daniels & Adrian, LLP

(57) ABSTRACT

An applied liquid applicator for discharging applied liquid by turning of an operating portion provided to a barrel main body achieves improved filling efficiency of the applied liquid stored in the barrel main body with respect to an inside capacity of the barrel main body. The applied liquid is fed to the applicator portion through the first valve and the applied liquid feed path by turning the operating portion and sliding the piston in the front-back direction by use of the cam mechanism portion.

5 Claims, 13 Drawing Sheets

(51) Int. Cl.

| | |
|---|---|
| ***B05C 17/01*** | (2006.01) |
| ***A46B 11/00*** | (2006.01) |
| ***B05B 11/00*** | (2006.01) |
| ***B43K 5/18*** | (2006.01) |

(52) U.S. Cl.
CPC ..... *B05B 11/0035* (2013.01); *B05B 11/0064* (2013.01); *B05B 11/3015* (2013.01); *B05B 11/3052* (2013.01); *B05B 11/3067* (2013.01); *B05B 11/3074* (2013.01); *B05C 17/0116* (2013.01); *B05C 17/0146* (2013.01); *B43K 5/1836* (2013.01); *B43K 5/1863* (2013.01); *A45D 2200/055* (2013.01); *B05B 11/00416* (2018.08)

(58) Field of Classification Search
CPC ..... B05B 11/3015; B05B 11/3052; B05B 11/3067; B05B 11/3074; B05B 11/00416; A61M 35/003
See application file for complete search history.

(56) References Cited

U.S. PATENT DOCUMENTS 6,688,796 B1 * 2/2004 Liu ..... A45D 34/042 401/172
2008/0205968 A1 * 8/2008 Malvar ..... A45D 34/04 401/138
2014/0050514 A1 * 2/2014 Uehara ..... A45D 40/262 401/143
2014/0097208 A1 * 4/2014 Sauvage ..... B05B 11/0035 222/183
2015/0108173 A1 * 4/2015 Kim ..... B05B 11/3015 222/321.8
2016/0144395 A1 * 5/2016 Brugger ..... A45D 40/262 401/150
2016/0242530 A1 * 8/2016 Son ..... A45D 34/04
2017/0079406 A1 * 3/2017 Roudaut ..... A45D 34/04
2017/0157377 A1 * 6/2017 Chang ..... A45D 34/04
2017/0181523 A1 * 6/2017 Jung ..... A45D 34/00
2017/0341102 A1 * 11/2017 Kang ..... B05C 1/06

FOREIGN PATENT DOCUMENTS

| | | | |
|---|---|---|---|
| JP | 11-206453 | A | 8/1999 |
| JP | 2007-130157 | A | 5/2007 |
| JP | 2011-142945 | A | 7/2011 |
| JP | 2012-157611 | A | 8/2012 |
| WO | 2012/026627 | A1 | 3/2012 |

* cited by examiner

APPLICATOR WITH ROTARY CAM PISTON MECHANISM

BACKGROUND OF THE INVENTION

Field of the Invention

The present invention relates to an applicator and particularly to an applicator with improved filling (volumetric) efficiency of stored applied liquid with respect to a volume (inside capacity) of a barrel.

Description of the Related Art

There is a known applicator as disclosed in JP 2007-130157 A, JP 2012-157611 A, and JP 2011-142945 A, in which, by turning a cap provided to a back end portion of a barrel, a liquid pressurizing mechanism including a piston and a threaded rod pressurizes an applied liquid storage portion in the barrel to feed applied liquid to a tip, or an applicator body at a tip end portion of the barrel.

The liquid pressurizing mechanism is disposed in an area from a middle portion to a back portion of the barrel to convert turning of the cap into a linear motion of the piston. To put it concretely, the threaded rod is provided between the cap and the piston, the piston alone or the threaded rod and the piston together move(s) forward in the applied liquid storage portion as the cap turns.

JP 11-206453 A discloses a side push container provided, on a side face of a container main body, with a side button for operating a valve mechanism. By pushing in the side button with a finger or taking the finger off the side button to stop a pushing operation, contents of a cartridge main body are pushed out.

In each of related-art applicators disclosed in JP 2007-130157 A and JP 2012-157611 A, the liquid pressurizing mechanism is disposed in an area from a middle portion to the back portion of the barrel and the piston and the threaded rod move together.

As a result, there is a technical problem in which the applied liquid storage portion cannot be provided in the area where the liquid pressurizing mechanism is disposed and a space for storing the applied liquid in the barrel is small. In other words, there is a technical problem in which filling (volumetric) efficiency of the stored applied liquid with respect to a volume (inside capacity) of the barrel is low.

In the related-art applicator disclosed in JP 2011-142945 A, the liquid pressurizing mechanism is disposed in the back portion of the barrel, the threaded rod is provided in the applied liquid storage portion, and the piston moves on the threaded rod.

As a result, in addition to reduction in the applied liquid storage space in the applied liquid storage portion by a volume of the threaded rod, there is a technical problem in which the applied liquid leaks from between the threaded rod and the applied liquid storage portion and a sealing property is insufficient.

The side push container shown in JP 11-206453 has a technical problem in which the side button gets hit by something to push out the contents (applied liquid) in the cartridge main body through carelessness.

With the above-described circumstances in view, the present inventors have made hard studies of an applicator with improved filling (volumetric) efficiency of applied liquid with respect to an inside capacity of a barrel based on the applicator for discharging the applied liquid stored in the barrel by turning of the operating portion provided to the barrel as shown in each of JP 2007-130157 A, JP 2012-157611 A, and JP 2011-142945 A, and conceived the present invention.

SUMMARY OF THE INVENTION

It is an object of the present invention to provide an applicator which discharges applied liquid by turning of an operating portion attached to a barrel main body and which has improved filling (volumetric) efficiency of the applied liquid stored in the barrel main body with respect to an inside capacity of the barrel main body.

In order to solve the above issue, an applicator according to the present invention and for discharging applied liquid by turning of an operating portion attached to a barrel main body includes: the barrel main body in which an applied liquid reservoir portion for storing the applied liquid is provided; the operating portion provided in front of the barrel main body to be able to turn with respect to the barrel main body; a piston which is slid in a front-back direction of the barrel main body by turning the operating portion; and a cam mechanism portion formed by a cam and a cam groove formed on the operating portion and the piston. The applied liquid is discharged by turning the operating portion and sliding the piston in the front-back direction by use of the cam mechanism portion.

Because the operating portion is provided in front of the barrel main body and the cam mechanism portion formed by the cam and the cam groove formed in the operating portion and piston is provided in this manner, it is possible to effectively utilize an inside of the barrel main body for storage of the applied liquid to thereby improve filling (volumetric) efficiency of the applied liquid stored in the barrel main body.

Here, the applicator according to the invention and for discharging the applied liquid by turning of the operating portion attached to the barrel main body preferably includes: the barrel main body in which the applied liquid reservoir portion for storing the applied liquid is provided; the operating portion provided to be able to turn with respect to the barrel main body; the piston which is slid in the front-back direction of the barrel main body by turning the operating portion; a through hole provided in the piston; an applied liquid feed path connected to the through hole in the piston to feed the applied liquid to an applicator portion; a first valve for opening and closing the through hole in the piston; and the cam mechanism portion formed by the cam and the cam groove formed on the operating portion and the piston. The applied liquid is preferably fed to the applicator portion through the first valve and the applied liquid feed path by turning the operating portion and sliding the piston in the front-back direction by use of the cam mechanism portion.

In this applicator, because the applied liquid is fed to the applicator portion through the first valve and the applied liquid feed path by turning the operating portion and sliding the piston in the front-back direction by use of the cam mechanism portion, the long threaded rod employed in the related-art applicator is unnecessary.

As a result, as compared with the related-art applicator, it is possible to secure the large space for storing the applied liquid to thereby improve the filling efficiency of the stored applied liquid with respect to an inside capacity of the barrel main body.

The applicator preferably further includes a spring for biasing the first valve in such a direction as to close the through hole in the piston. The piston is preferably slid by the cam mechanism portion, the first valve is preferably opened and the applied liquid is preferably fed to the applicator portion through the applied liquid feed path when pressure acting on the first valve is higher than or equal to a biasing force of the spring, and the first valve is preferably closed and feed of the applied liquid to the applicator portion is preferably interrupted when the pressure acting on the first valve is lower than the biasing force of the spring.

Because operation of the first valve is defined by the biasing force (repulsion) of the spring in this manner, it is possible to reliably cause the first valve to operate and feed and interruption of the applied liquid to the applicator portion are carried out without fail.

The applicator preferably further includes: a valve chest which is formed in a front space separated by a wall portion in the barrel main body and in which the piston moves forward and backward; the applied liquid reservoir portion formed in a back space by the wall portion; a through hole formed in the wall portion to connect the applied liquid reservoir portion and the valve chest; and a second valve for opening and closing the through hole in the wall portion. The second valve is preferably opened and the applied liquid in the applied liquid reservoir portion is preferably fed to the valve chest when a negative pressure is created in the valve chest by movement of the piston, and the second valve is preferably closed and feed of the applied liquid in the applied liquid reservoir portion to the valve chest is preferably interrupted when a positive pressure is created in the valve chest by movement of the piston.

Because the second valve is opened and closed in response to pressure change in the valve chest due to the movements of the piston, the feed and the interruption of the applied liquid to the valve chest are carried out without fail.

The cam mechanism portion is preferably a positive cam including: a cam groove which is formed in the operating portion and formed in a sinusoidal shape oscillating in the front-back direction; and the cam which is formed on the piston and housed in the cam groove.

Because the cam mechanism portion is the positive cam as described above, it is possible to reliably cause the piston to move forward and backward.

The applied liquid feed path preferably includes a through hole formed along an axis of the operating portion. Specifically, it is preferable that the through hole penetrates a central portion of the operating portion.

As described above, according to the invention, it is possible to obtain the applied liquid applicator for discharging the applied liquid by turning of the operating portion attached to the barrel main body, in which the filling (volumetric) efficiency of the applied liquid stored in the barrel main body with respect to the inside capacity of the barrel main body is improved.

BRIEF DESCRIPTION OF THE DRAWING

FIGS. 1A and 1B are views showing an embodiment of an applicator according to the present invention to which a cap is mounted, wherein FIG. 1A is a side view and FIG. 1B is a sectional view;

FIGS. 3A, 3B, 3C, and 3D are views of a barrel main body shown in FIG. 1A, wherein FIG. 3A is a perspective view, FIG. 3B is a sectional view, FIG. 3C is a sectional view taken along a direction at 90° with respect to a direction along which the sectional view in FIG. 3B is taken, and FIG. 3D is a side view;

FIGS. 4A, 4B, and 4C are views of a second valve shown in FIG. 1B, wherein FIG. 4A is a perspective view, FIG. 4B is a sectional view, and FIG. 4C is a side view;

FIGS. 5A and 5B are views of an operating portion shown in FIG. 1B, wherein FIG. 5A is a perspective view and FIG. 5B is a sectional view;

FIGS. 6A and 6B are views of a piston shown in FIG. 1B, wherein FIG. 6A is a perspective view and FIG. 6B is a sectional view;

FIGS. 7A and 7B are views of a first valve shown in FIG. 1B, wherein FIG. 7A is a perspective view and FIG. 7B is a side view;

FIGS. 8A and 8B are views showing an assembled state of the operating portion, the piston, the first valve, and a spring shown in FIG. 1B, wherein FIG. 8A is a side view and FIG. 8B is a sectional view;

DESCRIPTION OF THE PREFERRED EMBODIMENTS

An embodiment of an applicator according to the present invention will be described based on FIGS. 1A to 13.

Figure 1A:
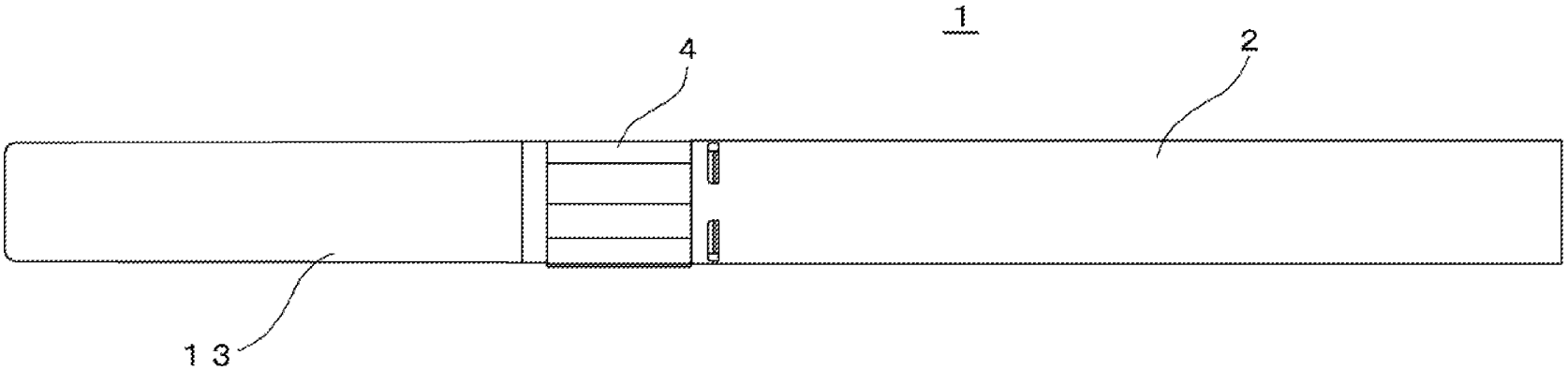
Figure 1B:
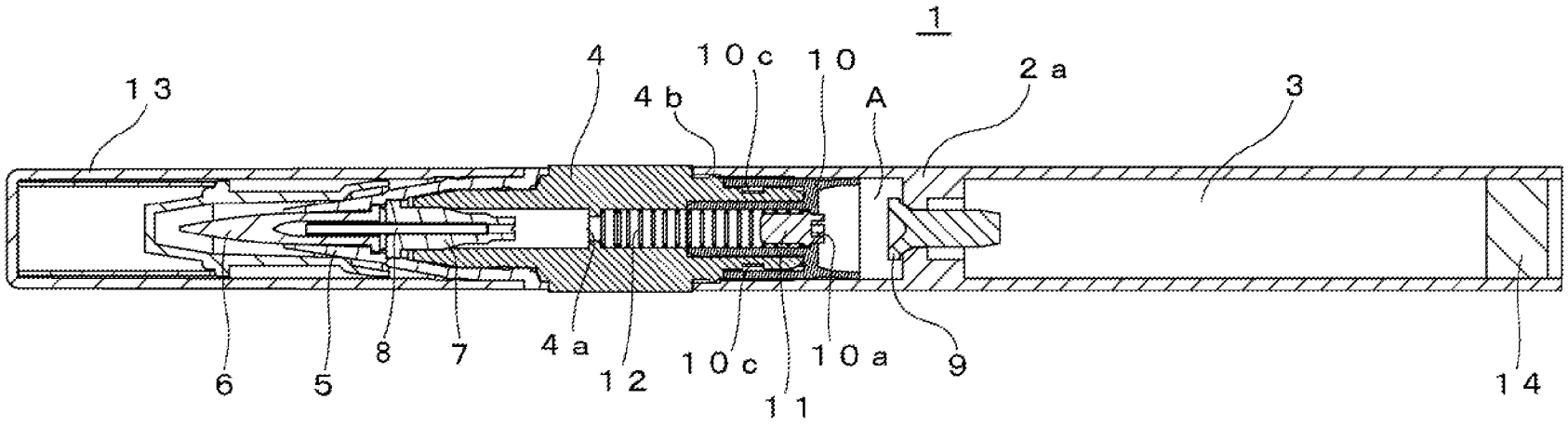

First, based on FIGS. 1B and 2, a general structure of the applicator according to the embodiment will be described. FIG. 1B is a sectional view of the embodiment of the applicator according to the invention to which a cap is mounted and FIG. 2 is a partially-sectional perspective view of the applicator according to the invention from which the cap is detached.

Figure 2:
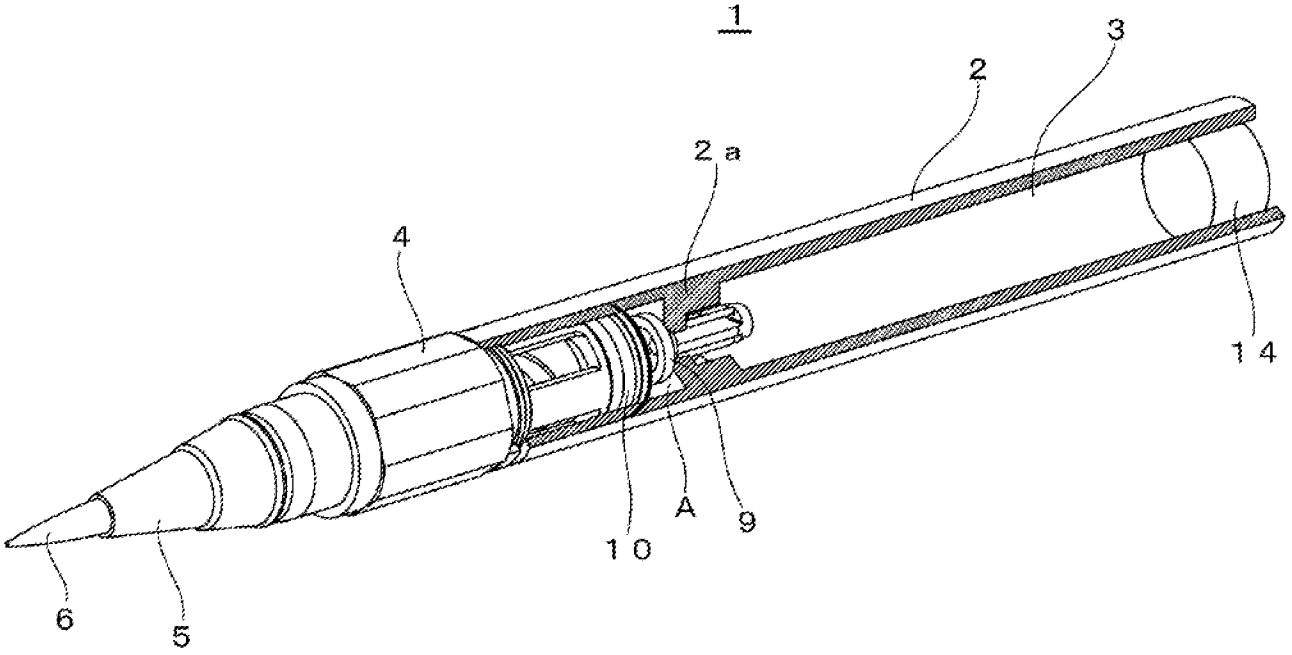
FIG. 2 is a partially-sectional perspective view of the applicator shown in FIG. 1B from which the cap is detached.

As shown in FIGS. 1B and 2, the applicator 1 includes a barrel main body 2 in which an applied liquid reservoir portion (storage portion) 3 for storing applied liquid is provided, an operating portion 4 provided to be able to turn with respect to the barrel main body 2, a front body 5 attached to one end portion of the operating portion 4, a tip (applicator portion) 6 mounted to the front body 5, and a pipe joint 7 and a pipe 8 for enabling feed of the applied liquid from the applied liquid reservoir portion 3 to the tip (applicator portion) 6.

In the barrel main body 2, a wall portion 2*a* forms a space for forming a valve chest A on a front side and a space for forming the applied liquid reservoir portion (storage portion) 3 for storing the applied liquid on a back side.

The wall portion 2*a* is positioned on the front side in the barrel main body 2 to thereby improve filling efficiency of the applied liquid stored in the barrel main body 2 with respect to an inside capacity of the barrel main body 2.

As described above, by mounting the operating portion 4 (piston 10) to a front end portion of the barrel main body 2, the valve chest A is formed.

The wall portion 2*a* of the barrel main body 2 is provided with a second valve 9 which closes when the valve chest A comes into a pressurized state (positive pressure state) and opens when the valve chest A comes into a depressurized state (negative pressure state). The second valve 9 functions as a check valve for preventing the applied liquid, which has flowed from the applied liquid reservoir portion 3 into the valve chest A, from flowing back into the applied liquid reservoir portion 3.

In a central portion of the operating portion 4, a through hole 4*a* through which the applied liquid flows is formed.

The joint 7 is fitted in a front end portion of the through hole 4*a*. The front body 5 is mounted to a front end portion of the operating portion 4. The through hole 4*a* and the pipe 8 form an applied liquid feed path from the applied liquid reservoir portion 3 to the tip (applicator portion) 6.

On the other hand, the piston 10 for sliding in the valve chest A is attached to a back end portion of the operating portion 4.

In a central portion of the piston 10, a through hole 10*a* communicating with the through hole 4*a* formed in the central portion of the operating portion 4 is formed. The through hole 10*a* is formed to be opened and closed by a first valve 11.

Moreover, a spring 12 is disposed in the through hole 10*a*, one end portion of the spring 12 is engaged in the operating portion 4, and the other end portion of the spring 12 is engaged in the first valve 11.

As a result, if pressure in the valve chest A becomes higher than or equal to a biasing force (repulsion) of the spring 12, the first valve 11 moves forward (toward the tip 6) against the spring force to open the through hole 10*a*.

On the other hand, if the pressure in the valve chest A becomes lower than the biasing force (repulsion) of the spring 12, the first valve 11 moves backward (toward a back end side of the barrel main body 2) to close the through hole 10*a*.

In FIG. 1B, reference sign 13 designates a cap and reference sign 14 designates a follower. The follower is an applied liquid following body and has a similar structure to a general ink follower body.

Next, the respective members forming the applicator according to the embodiment will be described in detail.

(Barrel Main Body 2)

Figure 3A:
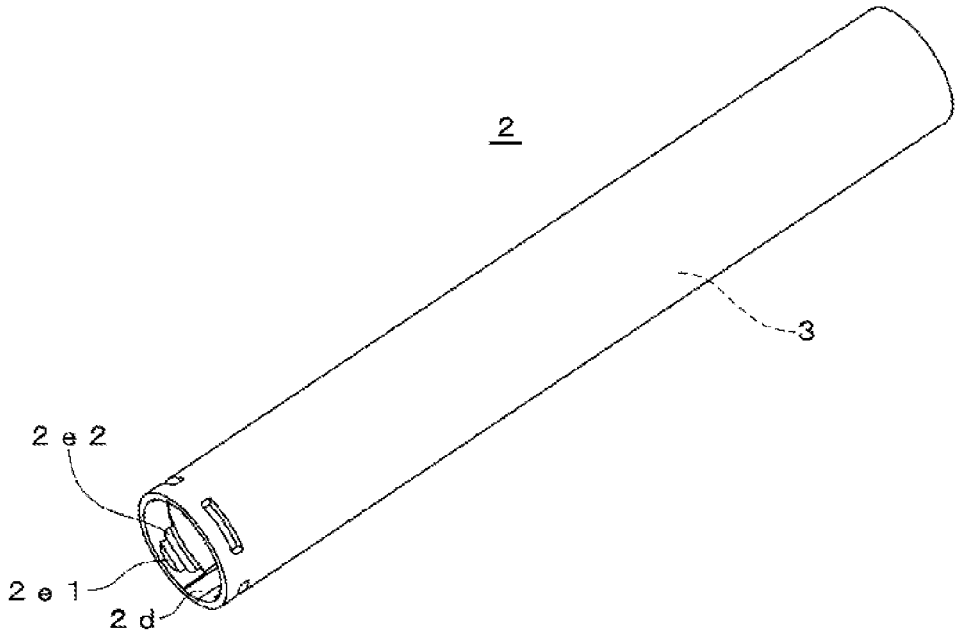
Figure 3B:
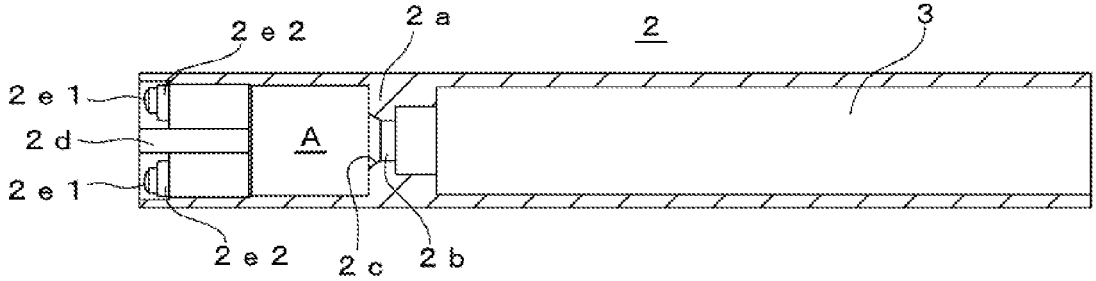
Figure 3C:
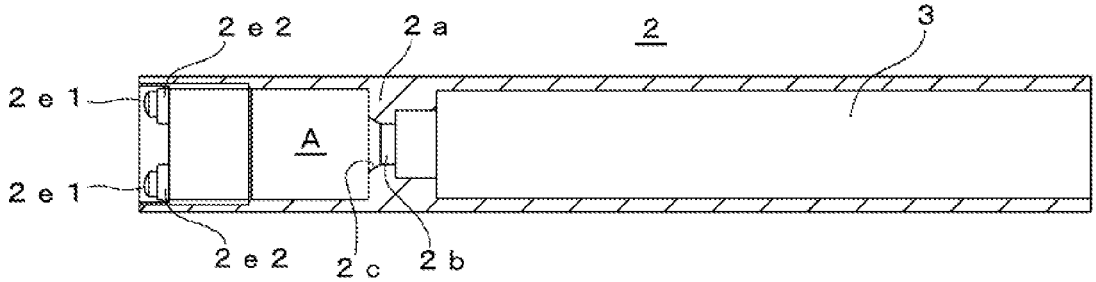
Figure 3D:
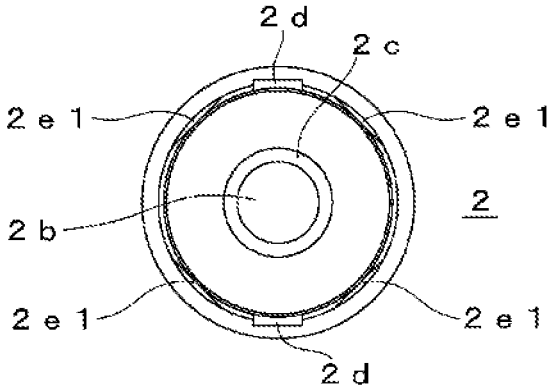

The barrel main body 2 is formed in a cylindrical shape as shown in FIG. 3A and provided with the applied liquid reservoir portion (storage portion) 3 which is about three fourths a length of the barrel main body 2. A back end portion of the barrel main body 2 is open and the follower 14 is disposed at a back end portion of the applied liquid stored in the applied liquid reservoir portion (storage portion) 3 (see FIG. 1B) to thereby seal the applied liquid reservoir portion (storage portion) 3.

A through hole 2*b* is formed in the wall portion 2*a* of the reservoir portion 3 of the barrel main body 2 and a valve stem 9*b* of the second valve 9 is inserted through the through hole 2*b*. On a valve chest A side of the wall portion 2*a*, a valve seat 2*c* on which a valve element 9*a* of the second valve 9 gets seated is provided.

Furthermore, in an inner peripheral face of the barrel main body 2, groove portions 2*d* are formed from the front end portion toward the valve chest A. The groove portions 2*d* are formed at intervals of 180° and face each other.

Protrusions 10*b* (see FIG. 6A) provided to an outer peripheral face of the piston 10 are inserted (housed) into the groove portions 2*d* and the piston 10 slides linearly in an axial direction of the barrel main body 2 without rotating.

On an inner peripheral face of the front end portion (on an operating portion side) of the barrel main body 2, four pairs of protruding portions 2*e*1, 2*e*2 protruding inward are formed.

By fitting a protruding portion 4*b* of the operating portion 4 between the protruding portions 2*e*1 and 2*e*2, the operating portion 4 is attached to the barrel main body 2 to be able to turn.

The protruding portions 2*e*1, 2*e*2 prevent movement of the operating portion 4 in the axial direction of the barrel main body 2.

(Second Valve 9)

Figure 4A:
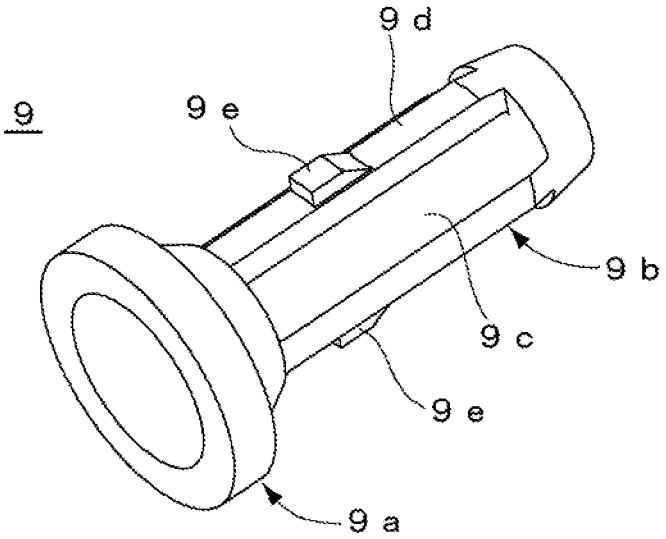
Figure 4B:
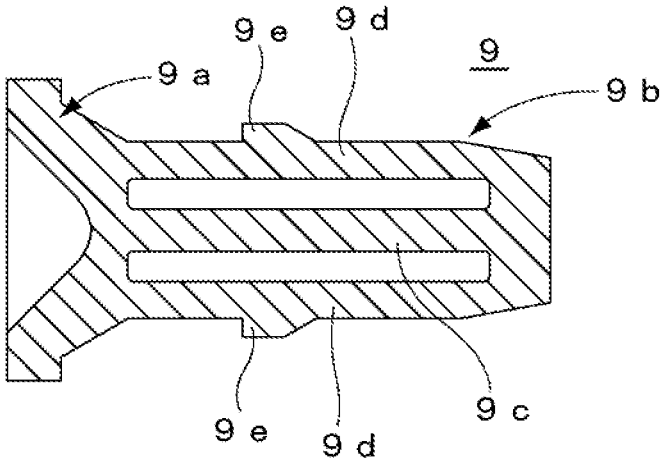
Figure 4C:
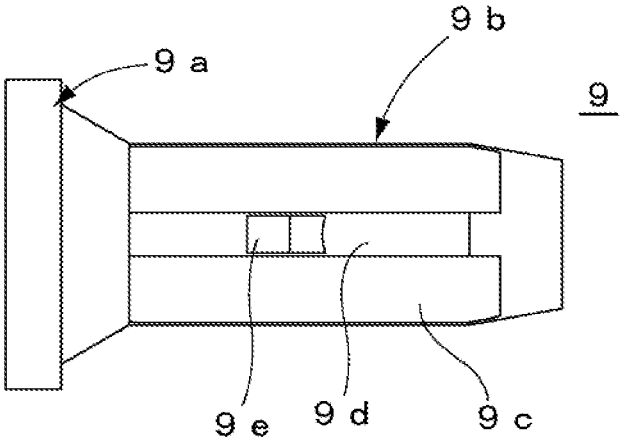

As shown in FIG. 4A, the second valve 9 includes the valve element 9*a* for opening and closing the through hole 2*b* in the barrel main body 2 and a guide rod (valve stem) 9*b* formed on a rear end portion side of the valve element 9*a*. The guide rod (valve stem) 9*b* has flat-plate-shaped portions 9*c* and bridge portions 9*d* and lock protrusions 9*e* are provided to outer peripheral faces of the bridge portions 9*d*.

If the guide rod (valve stem) 9*b* of the second valve 9 is inserted through the through hole 2*a* from a front side (valve chest A side) of the barrel main body 2, the bridge portions 9*d* bend and the lock protrusions 9*e* pass through the through hole 2*a*. As a result, the second valve 9 is attached to the barrel main body 2 with the wall portion 2*a* positioned between the valve element 9*a* and the lock protrusions 9*e*.

At this time, because dimensions between a back face of the valve element 9*a* and the lock protrusions 9*e* are greater than a thickness of the wall portion 2*a*, the second valve 9 is attached to be movable in a front-back direction of the barrel main body 2.

In other words, the second valve 9 can come into a state in which the second valve 9 contacts the valve seat 2*c* to close the through hole 2*a* or a state in which the second valve 9 moves away from the valve seat 2*c* to open the through hole 2*a*.

(Operating Portion 4)

Figure 5A:
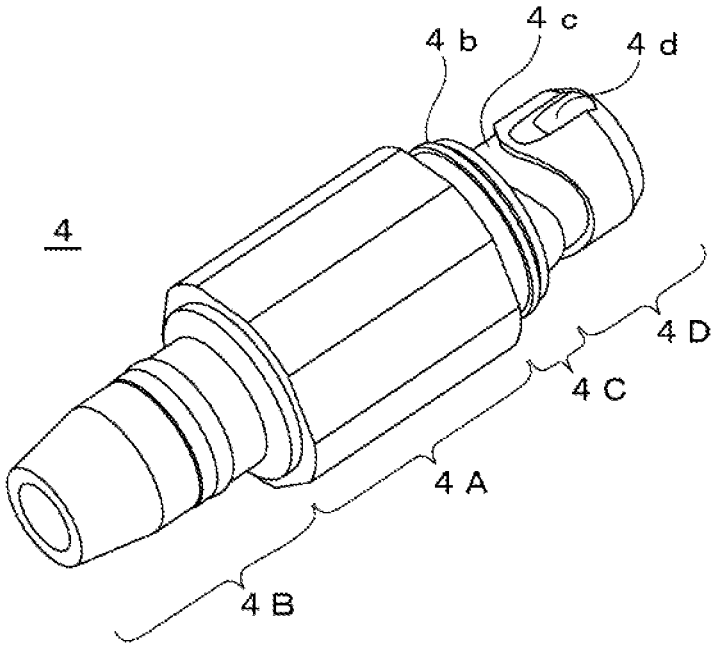
Figure 5B:
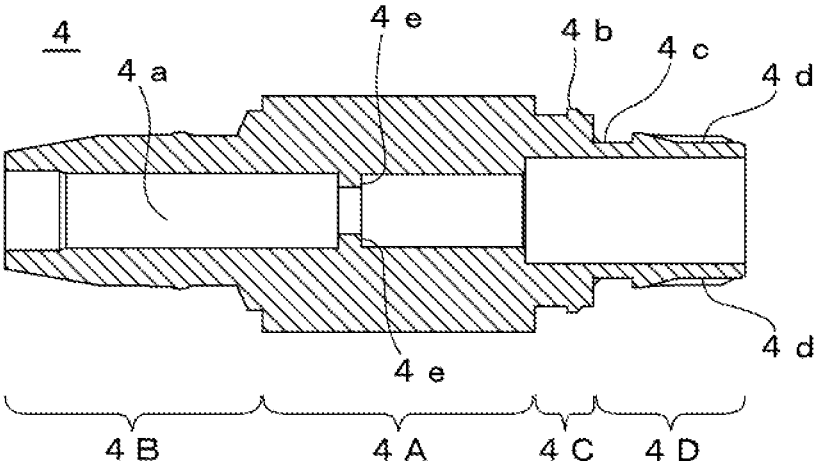

As shown in FIG. 5A, the operating portion 4 includes an operating face 4A which a user pinches to turn the operating portion 4, a front body attaching portion 4B provided to a front side (front body side) of the operating face 4A, a barrel main body attaching portion 4C provided to a back side (barrel main body side) of the operating face 4A, and a cam groove portion 4D provided to a barrel main body side (back side) of the barrel main body attaching portion 4C.

On an outer peripheral face of the barrel main body attaching portion 4C, the protruding portion 4*b* which is fitted between the protruding portions 2*e*1 and 2*e*2 of the barrel main body 2 is provided as described above.

This fitting allows the operating portion 4 to turn with respect to the barrel main body 2 while prohibiting the operating portion 4 from moving in the axial direction (front-back direction) of the barrel main body 2.

In an outer peripheral face of the cam groove portion 4D, a cam groove 4*c* in a sinusoidal shape oscillating in the front-back direction is formed. In the cam groove 4*c*, cams 10*c* (see FIGS. 6A and 6B) formed on the piston 10 are housed.

In this way, turning of the operating portion 4 causes the cams 10*c* (see FIGS. 6A and 6B) formed on the piston 10 to move in the cam groove 4*c* with respect to the cam groove 4*c*.

As a result, the piston 10 moves in the front-back direction with respect to the operating portion 4 (valve chest A). The cam groove 4*c* formed in the outer peripheral face of the cam groove portion 4D is for two cycles and the piston 10 reciprocates twice in the front-back direction with respect to the operating portion 4 (valve chest A) when the operating portion 4 is turned once.

In the cam groove portion 4D, insertion grooves 4*d* having slopes gradually sloping upward from end portions on a valve chest side toward the cam groove 4*c* are formed.

By putting the cams 10*c* of the piston 10 into the insertion grooves 4*d* and moving the cams 10*c* in the insertion grooves 4*d*, the cams 10*c* become housed (mounted) into the cam groove 4*c*.

Moreover, in the through hole 4*a*, a lock wall portion 4*e* to which the end portion of the spring 12 is locked is provided.

(Piston 10)

Figure 6A:
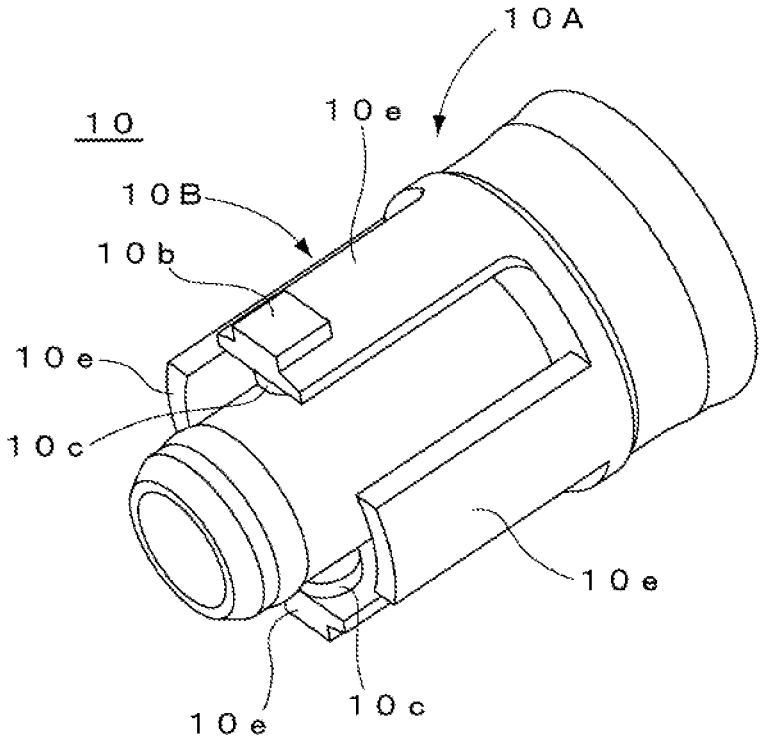
Figure 6B:
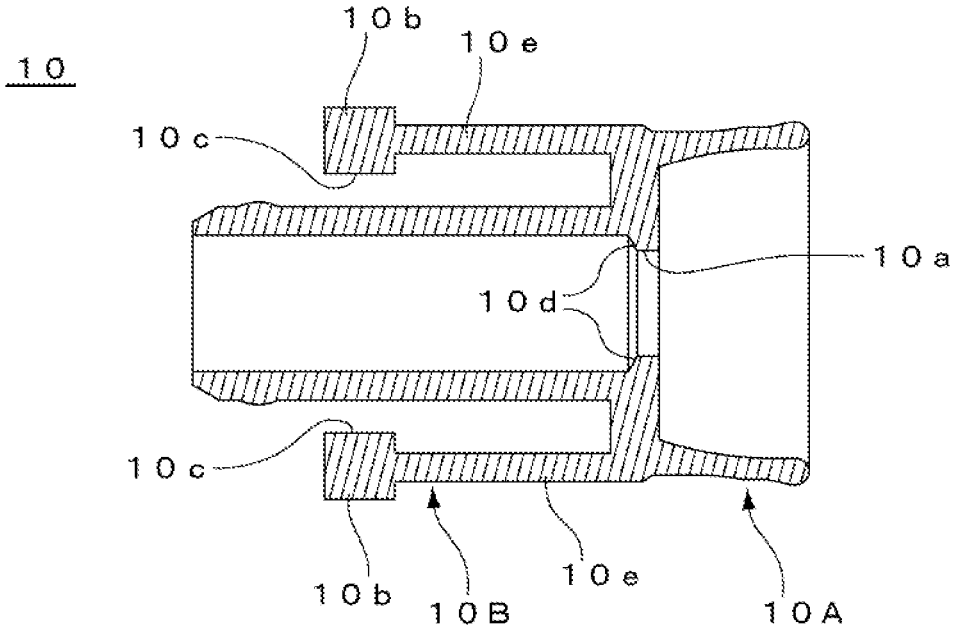

As shown in FIG. 6A, the piston 10 includes a piston portion 10A on a back side (valve chest A side) and a cam portion 10B on a front side (operating portion 4 side).

The piston portion 10A is formed into a cylindrical shape with a bottom and has an outer peripheral face which comes in contact with the inner peripheral face of the barrel main body 2 forming the valve chest A without leaving a clearance between the outer peripheral face and the inner peripheral face and the piston 10 slides to thereby pressurize the valve chest A.

As described above, the through hole 10*a* is formed in a central portion of a bottom face portion of the piston portion 10A. A valve seat 10*d* is provided in front of the central portion of the bottom face portion and the first valve 11 is seated on the valve seat 10*d* by the repulsion of the spring 12.

The cam portion 10B includes leg portions 10*e* having one end portions connected to an outer peripheral portion of the bottom face of the piston portion 10A. The four leg portions 10*e* are provided at intervals of 90°.

The cam 10*c* is provided on an inner peripheral face of a tip end portion of each of the two leg portions 10*e* (leg portions provided at intervals of 180°) out of the leg portions 10*e*. The protrusion 10*b* is formed on an outer peripheral face of each of the leg portions 10*e* provided with the cams 10*c*.

The protrusions 10*b* get fitted into the groove portions 2*d* in the barrel main body 2 to slide in the groove portions 2*d*.

In this way, even if the operating portion 4 (cam groove 4*c*) turns, the piston 10 does not turn and is caused to move in the front-back direction in the valve chest A by the cam groove portion 4D (cam groove 4*c*) of the operating portion 4 and the cams 10*c*.

A cam mechanism portion formed by the cams 10*c* and the cam groove 4*c* is a positive cam, because movements of the cams are restricted.

(First Valve 11)

Figure 7A:
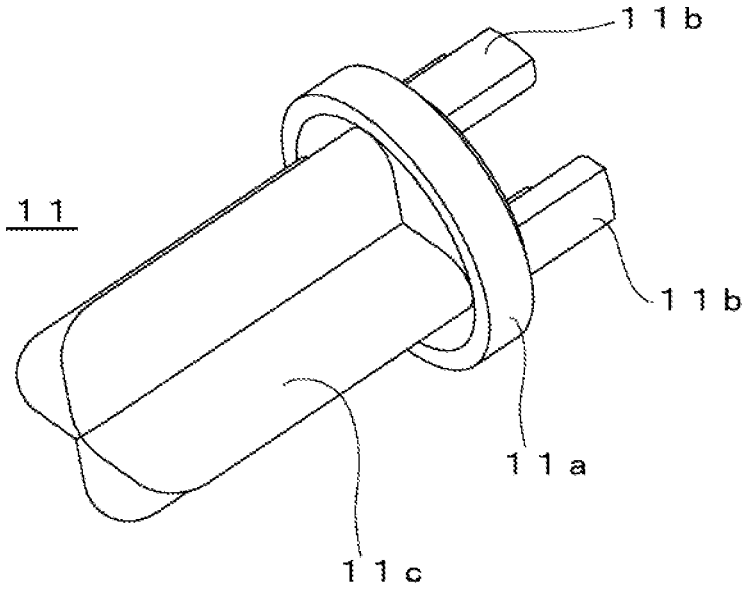
Figure 7B:
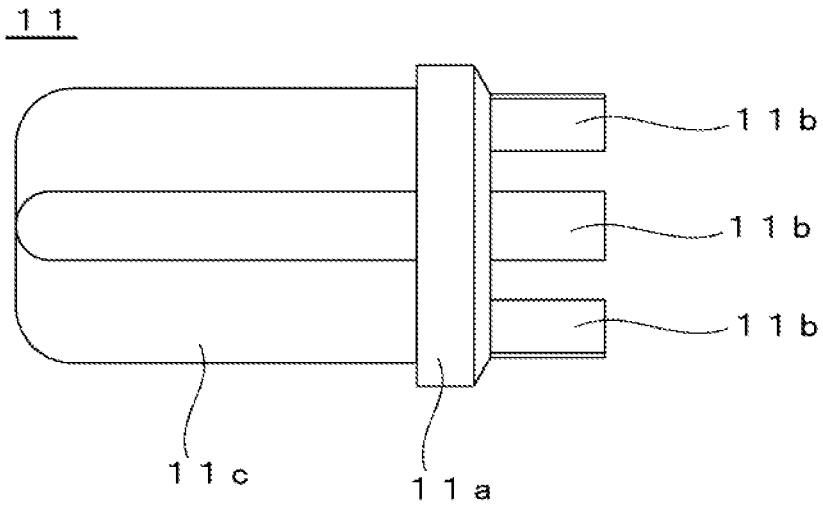

As shown in FIG. 7A, the first valve 11 includes a valve element 11*a* for opening and closing the through hole 10*a* of the piston 10 and guide rods 11*b* formed on a rear end portion side of the valve element 11*a*.

The first valve 11 includes a positioning rod 11*c* on a front end portion side of the valve element 11*a*. The positioning rod 11*c* is inserted into the spring 12 to prevent positional displacement between the spring 12 and the first valve 11.

A coil spring is used as the spring 12 and the positioning rod 11*c* is housed in a space in a central portion of the coil spring.

(Assembly Formed by Operating Portion 4, Piston 10, First Valve 11, and Spring 12)

Figure 8A:
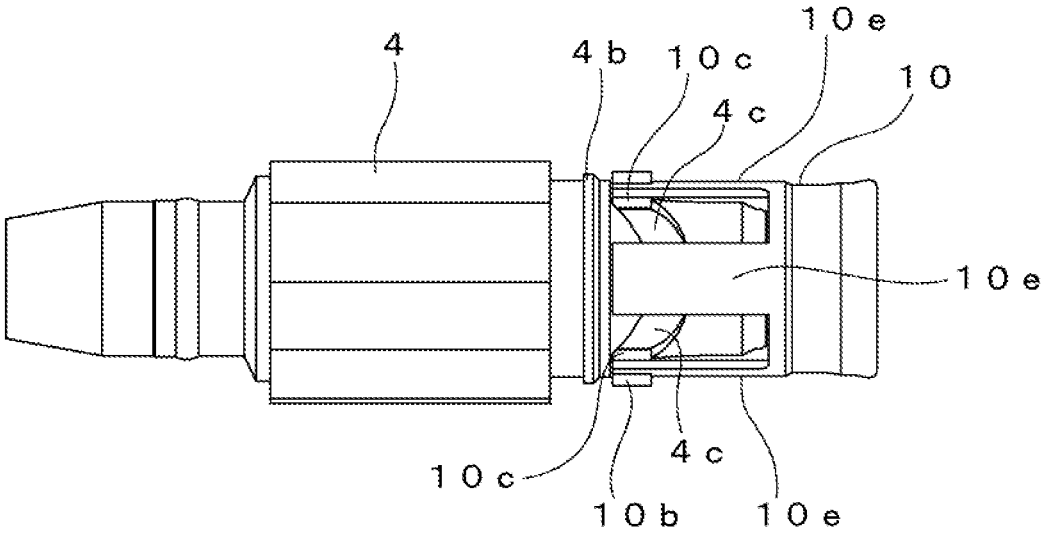
Figure 8B:
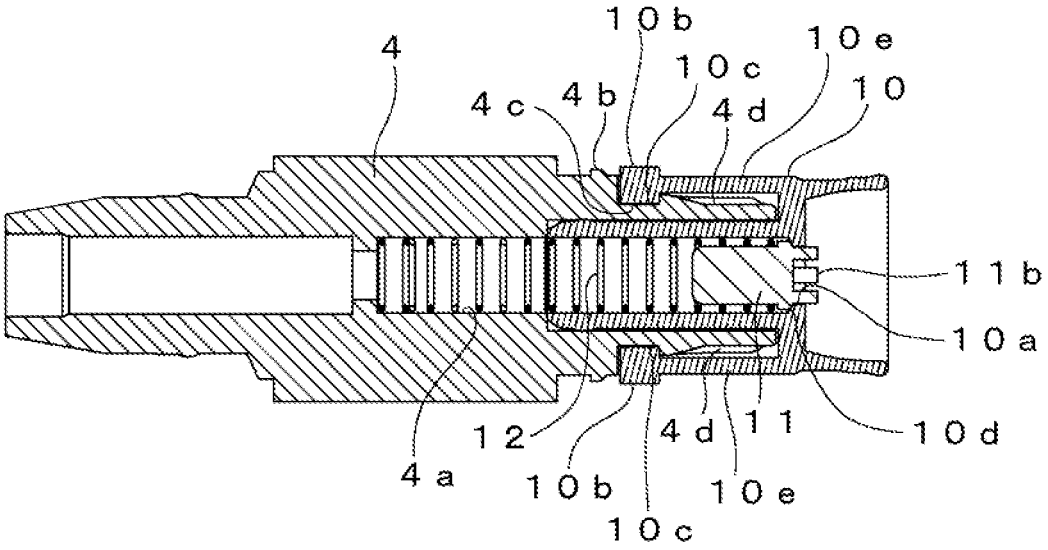

FIG. 8B shows an assembly formed by the operating portion 4, the piston 10, the first valve 11, and the spring 12.

To assemble the operating portion 4, the piston 10, the first valve 11, and the spring 12, the spring 12 is first inserted into the through hole 4*a* in the operating portion 4 and the positioning rod 11*c* of the first valve 11 is inserted into the spring 12.

Then, the cams 10*c* of the piston 10 are slid on the insertion grooves 4*d* of the operating portion 4 and the cams 10*c* are housed into the cam groove 4*c*.

At this time, the leg portions 10*e* of the piston 10 on which the cams 10*c* are formed expand outward. When the cams 10*c* are housed into the cam groove 4*c*, the leg portions 10*e* return into original states.

In housing the cams 10*c* into the cam groove 4*c*, the guide rods 11*b* of the first valve 11 are inserted into the through hole 10*a* of the piston.

In the state in which the cams 10*c* are housed in the cam groove 4*c*, the valve element 11*a* of the first valve 11 is seated on the valve seat 10*d* formed in the piston 10 by the repulsion of the spring 12.

(Assembly of Applicator 1)

Next, assembly of the applicator 1 will be described.

The assembly is mounted from a front end portion of the barrel main body 2 to which the second valve 9 is mounted.

At this time, the protruding portion 4*b* of the operating portion 4 is fitted between the protruding portions 2*e*1 and 2*e*2 of the barrel main body 2. In this way, the operating portion 4 is mounted to be able to turn without moving in the front-back direction with respect to the barrel main body 2.

The protrusions 10*b* of the piston 10 are housed into the groove portions 2*d* of the barrel main body 2. In this way, the piston 10 is mounted to move in the front-back direction without turning with respect to the barrel main body 2 even when the operating portion 4 turns.

Then, the joint 7 to which the pipe 8 is mounted and the front body 5 to which the tip 6 is mounted is attached to the front end portion of the operating portion 4.

On the other hand, the predetermined applied liquid is introduced and stored into the applied liquid reservoir portion 3 from a back end portion of the barrel main body 2 and then the follower is inserted to thereby complete the applicator 1.

Next, operation and workings of the applicator 1 will be described based on FIGS. 9 to 13. In FIGS. 9 to 13, reference sign P designates a reference position which is a piston position shown in FIG. 9.

Figure 9:
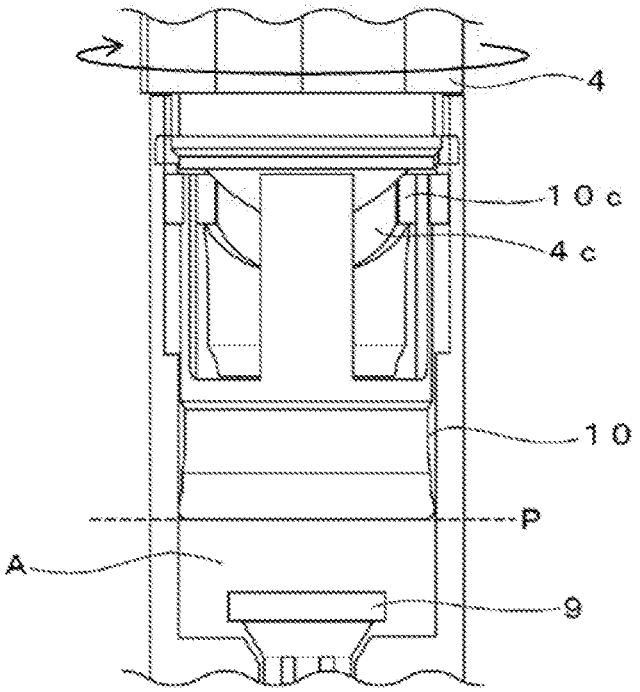
FIG. 9 is a sectional view of a relevant portion and for explaining an operating state of the embodiment shown in FIG. 1B.

In a state shown in FIG. 9, the applied liquid is filled in the valve chest A.

In the state shown in FIG. 9, the pressure in the valve chest A equals to pressure in the applied liquid reservoir portion 3, the applied liquid stops flowing from the applied liquid reservoir portion into the valve chest, and the second valve 9 is open.

The first valve 11 is closed by the spring 12.

From the state shown in FIG. 9, the operating portion 4 is turned in a direction of an arrow in FIG. 9.

Figure 10:
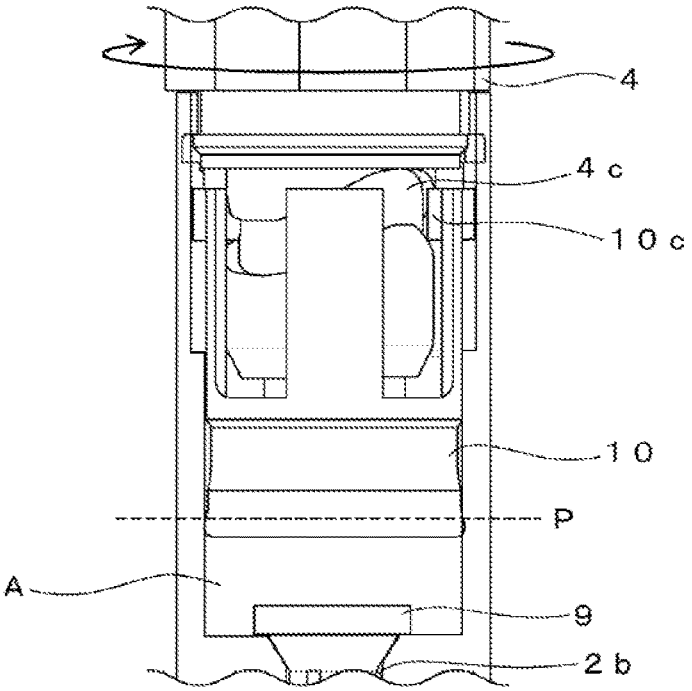
FIG. 10 is a sectional view of the relevant portion and for explaining an operating state following FIG. 9.

As a result of this turning, the cams 10*c* move along the cam groove 4*c* and the piston 10 moves backward, or downward in FIG. 9, and a state shown in FIG. 10 is reached.

In the state shown in FIG. 10, the valve chest A comes into the pressurized state (positive pressure state) due to the movement of the piston 10 and the second valve 9 moves in the through hole 2*b* due to the pressure to close the through hole 2*b*. In other words, the second valve 9 prevents backflow from the valve chest A into the applied liquid reservoir portion 3.

On the other hand, the first valve 11 opens against the repulsion of the spring 12 due to the pressure in the valve chest A and the applied liquid in the valve chest A is fed to the through hole 10*a*, the pipe 8, and the tip 6.

Then, from the state shown in FIG. 10, the operating portion 4 is turned in a direction of an arrow in FIG. 10.

Figure 11:
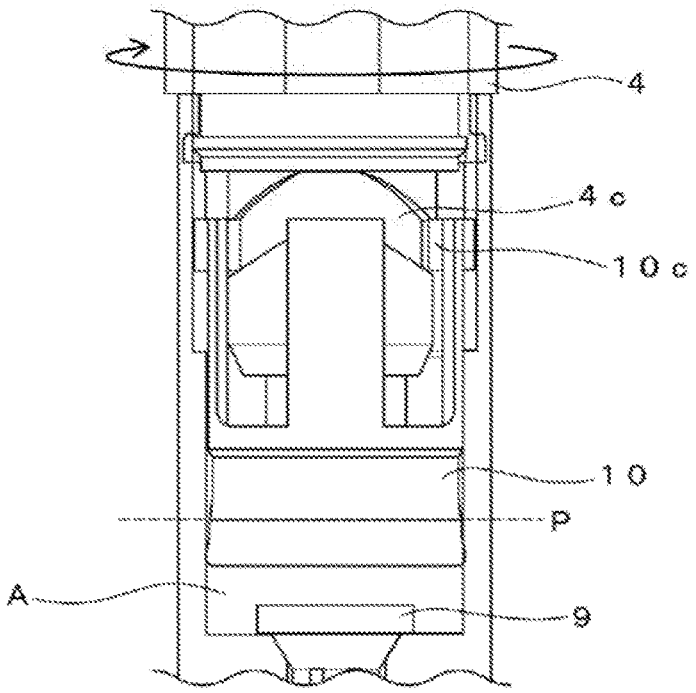
FIG. 11 is a sectional view of the relevant portion and for explaining an operating state following FIG. 10.

As a result of this turning, the cams 10*c* move along the cam groove 4*c*, the piston 10 moves backward (downward), and a state shown in FIG. 11 is achieved. FIG. 11 shows the state in which the piston 10 has moved to a most back side.

Due to the movement of the piston 10, the applied liquid in the valve chest A is further fed to the through hole 10*a*, the pipe 8, and the tip 6 and discharge of the applied liquid filled in the valve chest A ends.

Figure 12:
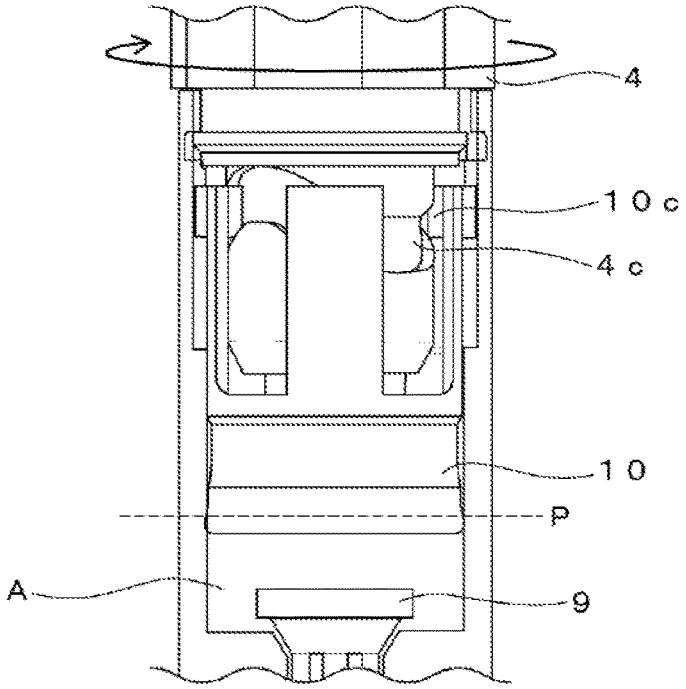
FIG. 12 is a sectional view of the relevant portion and for explaining an operating state following FIG. 11.

Then, the operating portion 4 is turned from the state shown in FIG. 11 and a state shown in FIG. 12 is reached.

In other words, due to the turning of the operating portion 4, the cams 10*c* move along the cam groove 4*c* and the piston 10 moves forward, which is upward in FIG. 12.

The valve chest A comes into the depressurized state (negative pressure state) due to the movement of the piston 10 and the second valve 9 moves in the through hole 2*b* due to the pressure to open the through hole 2*b* and the applied liquid in the applied liquid reservoir portion 3 starts to flow into the valve chest A.

At this time, the first valve 11 is closed by the spring 12.

Figure 13:
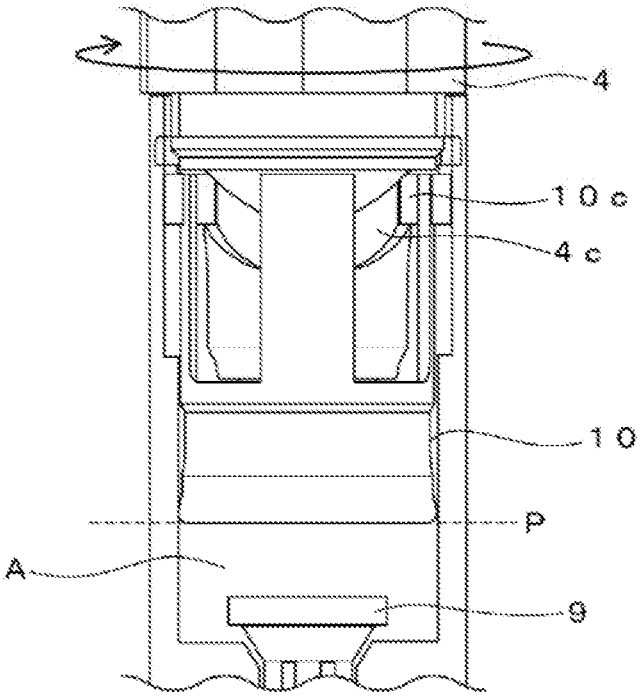
FIG. 13 is a sectional view of the relevant portion and for explaining an operating state following FIG. 12.

If the operating portion 4 is further turned from the state shown in FIG. 12 into the state shown in FIG. 13, the cams 10*c* move along the cam groove 4*c* and the piston 10 moves forward, which is upward in FIG. 12.

As a result of the movement of the piston 10, the applied liquid in the applied liquid reservoir portion 3 further flows into the valve chest A and the valve chest A is filled with the applied liquid.

When the forward movement of the piston 10 stops, the inflow of the applied liquid stops and a state shown in FIG. 9 is reached.

By repeating such a series of operations by turning the operating portion 4, it is possible to discharge the applied liquid in the applied liquid reservoir portion 3.

Although the operating portion 4 is turned in one direction in the case shown in FIGS. 9 to 13, similar workings and effects can be obtained when the operating portion 4 is turned in the other direction.

The applicator according to the invention can be used for various purposes, e.g., makeup applicators for storing applied liquid such as nail polish, applicators for storing applied liquid such as hair growth tonic, writing implements for storing applied liquid such as Chinese ink, shoe cleaners for storing the applied liquid such as shoe cream, containers for storing seasonings such as soy sauce, and containers for storing agents for mouth cavities such as toothpaste. As the applied liquid, low to high viscosity applied liquids can be used.

Although the cylindrical barrel main body has been described as an example in the above-described embodiment, a barrel main body may be formed in what is called a bottle shape having an increased capacity of an applied liquid storage portion. In this case, a second valve 9 may be provided to a mouth portion of the bottle and an assembly formed by an operating portion 4, a piston 10, a first valve 11, a spring 12, and the like may be mounted to the mouth portion.

Although an inside of the barrel main body is used as the applied liquid reservoir portion 3 in the example in the above-described embodiment, a tank storing the applied liquid may be housed in a barrel main body.

What is claimed is:

1. An applicator for discharging applied liquid by turning of a rotating operating portion attached to a barrel main body, the applicator comprising:

the barrel main body in which an applied liquid reservoir portion for storing the applied liquid is provided;

the rotating operating portion provided in front of the barrel main body to be able to turn with respect to the barrel main body;

a piston which is slid in a front-back direction of the barrel main body by turning the rotating operating portion;

a cam mechanism portion, comprising a cam formed on the piston and a cam groove formed on the rotating operating portion, the applied liquid being discharged by operation of the cam mechanism portion, a through hole provided in the piston;

an applied liquid feed path communicating with the through hole in the piston to feed the applied liquid to an applicator portion;

a first valve for opening and closing the through hole provided in the piston, the applied liquid being discharged through the first valve and the applied liquid feed path;

a through hole formed in the rotating operating portion, communicating with the through hole provided in the piston; and a spring for biasing the first valve in such a direction as to close the through hole provided in the piston;

wherein the applied liquid is discharged by turning the rotating operating portion and sliding the piston in the front-back direction by use of the cam mechanism portion, and wherein a first end portion of the spring is engaged in the rotating operating portion and a second end portion of the spring being engaged in the first valve.

2. The applicator according to claim 1, wherein the cam mechanism portion is a positive cam, wherein the cam groove is formed in a sinusoidal shape oscillating in the front-back direction.

3. The applicator according to claim 1, wherein the applied liquid feed path includes a through hole formed along an axis of the rotating operating portion.

4. The applicator according to claim 1, wherein the first valve is opened and the applied liquid is fed to the applicator portion through the applied liquid feed path when pressure acting on the first valve is higher than or equal to a biasing force of the spring, and wherein the first valve is closed and feed of the applied liquid to the applicator portion is interrupted when the pressure acting on the first valve is lower than the biasing force of the spring.

5. The applicator according to claim 4, further comprising:

a valve chest which is formed in a front space separated by a wall portion in the barrel main body and in which the piston moves forward and backward;

a back space disposed on an opposite side of the wall portion as the front space, the back space comprising the applied liquid reservoir portion;

a through hole formed in the wall portion to connect the applied liquid reservoir portion and the valve chest; and a second valve for opening and closing the through hole in the wall portion, wherein the second valve is opened and the applied liquid in the applied liquid reservoir portion is fed to the valve chest when a negative pressure is created in the valve chest by movement of the piston, and wherein the second valve is closed and feed of the applied liquid in the applied liquid reservoir portion to the valve chest is interrupted when a positive pressure is created in the valve chest by movement of the piston.

* * * * *